US011982134B2

(12) United States Patent
Tenorio et al.

(10) Patent No.: US 11,982,134 B2
(45) Date of Patent: May 14, 2024

(54) DRAPE HOSE QUICK CONNECT FOR MANAGED PRESSURE DRILLING

(71) Applicant: SCHLUMBERGER TECHNOLOGY CORPORATION, Sugar Land, TX (US)

(72) Inventors: Harold Tenorio, Houston, TX (US); Jon Tyler, Houston, TX (US); Ross Stevenson, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/043,737

(22) PCT Filed: Aug. 31, 2021

(86) PCT No.: PCT/US2021/048443

§ 371 (c)(1),
(2) Date: Mar. 2, 2023

(87) PCT Pub. No.: WO2022/051278

PCT Pub. Date: Mar. 10, 2022

(65) Prior Publication Data

US 2023/0265725 A1 Aug. 24, 2023

Related U.S. Application Data

(60) Provisional application No. 63/073,760, filed on Sep. 2, 2020.

(51) Int. Cl.
*E21B 17/08* (2006.01)
*E21B 21/00* (2006.01)
(Continued)

(52) U.S. Cl.
CPC ..... *E21B 17/0853* (2020.05); *E21B 21/001* (2013.01); *E21B 21/10* (2013.01); *E21B 33/06* (2013.01)

(58) Field of Classification Search
CPC .... E21B 17/01; E21B 17/085; E21B 17/0853; E21B 21/106; E21B 33/06
See application file for complete search history.

(56) References Cited

U.S. PATENT DOCUMENTS 9,719,310 B2 * 8/2017 MacGregor ..... E21B 19/004
9,970,247 B2 * 5/2018 Fraczek ..... E21B 17/01
(Continued)

FOREIGN PATENT DOCUMENTS

WO 2005028807 A1 3/2005

OTHER PUBLICATIONS

Search Report and Written Opinion of International Patent Application No. PCT/US2021/048443 dated Dec. 22, 2021; 11 pages.

*Primary Examiner* — Matthew R Buck
(74) *Attorney, Agent, or Firm* — Jeffrey D. Frantz

(57) ABSTRACT

A riser fluid handling system for managed pressure drilling includes a tubular portion having a lower end configured to be connected to a riser and an upper end, a spool connected to the upper end of the tubular portion, the spool having a base and a fluid conduit extending radially outward from the base and defining an axially-facing orifice. The fluid conduit is configured to provide fluid communication between the orifice and an interior of the spool. The system includes a valve connected to the fluid conduit and extending parallel to a central longitudinal axis of the tubular portion, the valve being configured to connect to a drape hose such that the drape hose extends axially therefrom and is able to swivel with respect to the spool.

20 Claims, 3 Drawing Sheets

(51) Int. Cl.
*E21B 21/10* (2006.01)
*E21B 33/06* (2006.01)

(56) References Cited

U.S. PATENT DOCUMENTS

| | | | | |
|---|---|---|---|---|
| 10,612,317 | B2 * | 4/2020 | Fraczek | E21B 17/01 |
| 11,708,727 | B2 * | 7/2023 | Stephen | E21B 17/085<br>166/380 |
| 2014/0083711 | A1 * | 3/2014 | Springett | E21B 17/01<br>166/345 |
| 2017/0184228 | A1 * | 6/2017 | Kotrla | E21B 33/06 |
| 2018/0038183 | A1 * | 2/2018 | Tindle | E21B 17/01 |

* cited by examiner

DRAPE HOSE QUICK CONNECT FOR MANAGED PRESSURE DRILLING

CROSS-REFERENCE TO RELATED APPLICATIONS

This application is a National Stage Entry of International Patent Application No. PCT/US2021/048443, filed on Aug. 31, 2021, which claims priority to U.S. Provisional Patent Application No. 63/073,760, filed on Sep. 2, 2020 and which is incorporated herein by reference in its entirety.

BACKGROUND

In offshore drilling systems, a series of tubulars, referred to as a "riser", extends from the platform at the surface to the sea floor. The riser may connect to wellhead equipment at the sea floor, such as blowout preventers, Christmas trees, etc. Tubular strings, such as drill strings, may extend through the riser and down into the well. Accordingly, an annulus may be defined in the riser between the outer diameter of the drill string and the inside diameter of the riser.

Fluid, e.g. drilling mud, may be circulated into and/or out of the riser annulus. For example, in managed pressure drilling, the pressure of the fluid in the riser, and thus the wellbore annulus below, may be controlled by controlling the pressure of this fluid (along with other characteristics, such as fluid density, composition, etc.). Equipment is used to control the fluid pressure, such as valves, chokes, seals, sensors, etc.

Typically, one such piece of equipment is a riser gas handler. The riser gas handler is a cylindrical member positioned in the moon pool (a level of the platform below the deck). The riser gas handler includes valves, and one or more hoses are connected to the valves to permit fluid circulation therein. In order to connect the hoses to the valves, specialized connections known as "goosenecks" are connected to the valves. These goosenecks provide for dual 90-degree bends in the flowpath, with one side connected to the valve and the other side connected to a hose. The hose is thus prevented from turning through such an angle. Additionally, the gooseneck provides a robust structure that mitigates erosion effects from the drilling mud coursing therethrough.

However, goosenecks represent potential leak points, and thus generally call for periodic inspection and maintenance. Further, goosenecks represent a non-negligible weight that is added to the riser gas handler.

SUMMARY

Embodiments of the disclosure include a riser fluid handling system for managed pressure drilling including a tubular portion having a lower end configured to be connected to a riser and an upper end, and a spool connected to the upper end of the tubular portion, the spool having a base and a fluid conduit extending radially outward from the base and defining an axially-facing orifice. The fluid conduit is configured to provide fluid communication between the orifice and an interior of the spool. The system also includes a valve connected to the fluid conduit and extending parallel to a central longitudinal axis of the tubular portion, the valve being configured to connect to a drape hose such that the drape hose extends axially therefrom and is able to swivel with respect to the spool.

Embodiments of the disclosure also include a riser system including a blowout preventer, a riser, a riser fluid handling system comprising, an upper connector connected to the blowout preventer, a lower connector connected to the riser, and a spool having an interior that is in fluid communication with the riser and the blowout preventer, the spool being connected to the upper connector. The spool comprises a base and a plurality of fluid conduits extending radially and axially from the base and configured to fluidly communicate with the interior of the spool. The riser fluid handling system also includes a plurality of valves, each of the valves connected to a respective one of the fluid conduits. The riser system further includes a plurality of drape hoses, each of the drape hoses connected to a respective one of the valves, such that the drape hoses each extend axially, with respect to the spool, therefrom and each is able to swivel with respect to the spool.

Embodiments of the disclosure further include a riser fluid handling system including an upper flange configured to connect to a blowout preventer, a lower flange configured to connect to a riser, a spool connected to the upper flange, a tubular member connected to the lower flange and the spool, such that a fluid flowpath is defined between the upper and lower flanges via an interior of the spool and the tubular member, a plurality of fluid conduits extending radially outward from the spool and downward toward the lower flange, the fluid conduits being configured to fluidly communicate with the interior of the spool, a plurality of valves, each of the valves connected to a respective one of the fluid conduits and extending therefrom toward the lower flange, and a plurality of connector assemblies, each connected to a respective one of the plurality of valves. The plurality of connector assemblies extend straight in an axial direction and do not define a gooseneck. The plurality of connector assemblies are configured to connect to a plurality of drape hoses such that the drape hoses each extend downward therefrom, toward the lower flange, and curve toward a radial orientation, with respect to the spool. The connector assemblies are configured to permit the drape hoses to swivel with respect to the spool, and the connector assemblies are configured to suspend at least a portion of the drape hoses from the valve and the fluid conduits.

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

BRIEF DESCRIPTION OF THE DRAWINGS

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

DETAILED DESCRIPTION

Reference will now be made in detail to specific embodiments illustrated in the accompanying drawings and figures. In the following detailed description, numerous specific details are set forth in order to provide a thorough understanding of the embodiments described herein. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the techniques herein is for the purpose of describing particular embodiments only and is not intended to be limiting. As used in the description of the techniques herein and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
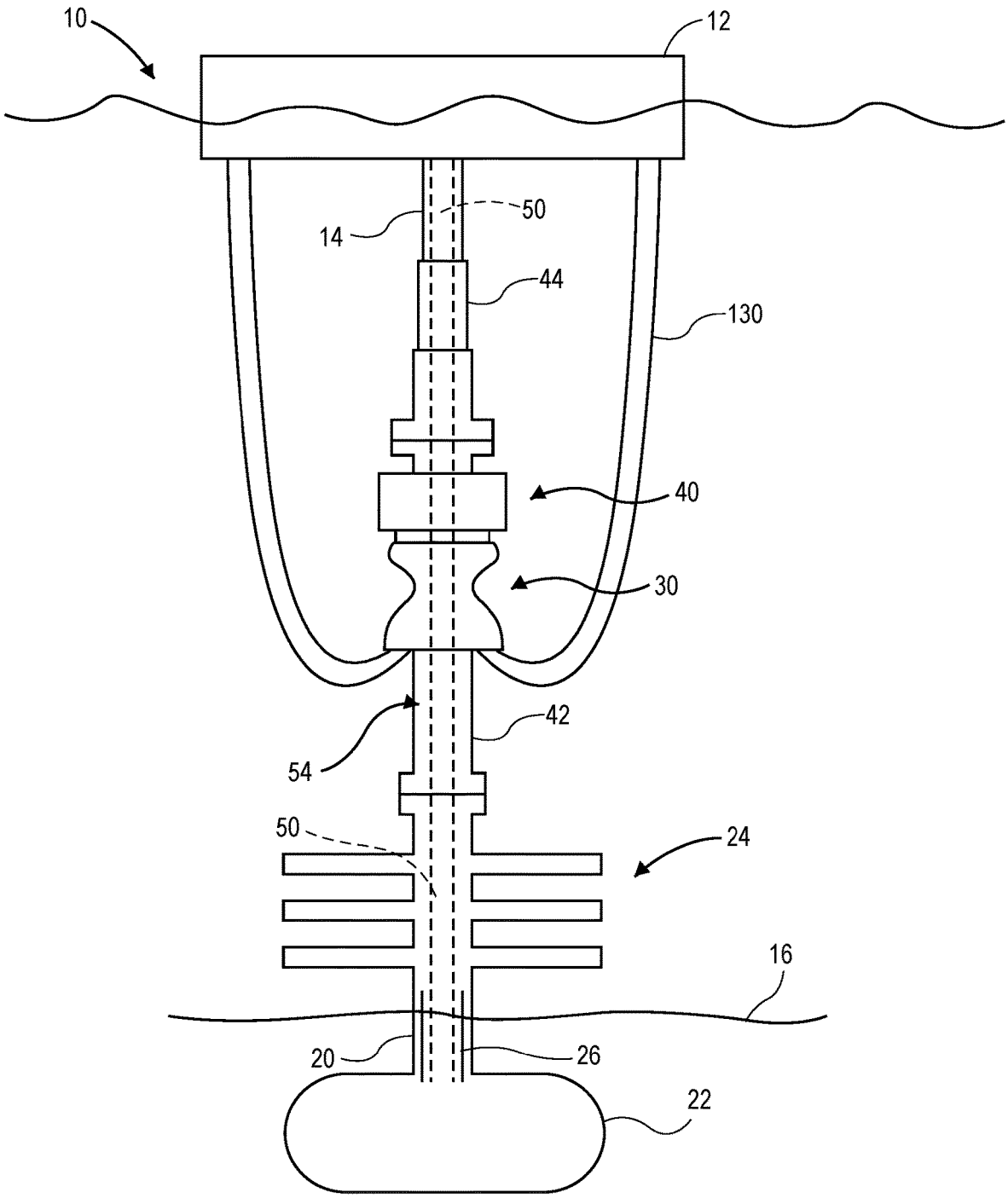
FIG. 1 illustrates a schematic view of an offshore wellsite system, according to an embodiment.

FIG. 1 illustrates a schematic view of a wellsite system 10, according to an embodiment. The wellsite system 10 generally includes an offshore rig 12, which may be a barge, submersible, platform, jackup, semisubmersible, drill ship, etc. A riser 14 may extend from the rig 12, toward the sea floor 16. Further, a well 20 may be drilled into sea floor 16 for extracting fluids from subsea reservoir 22 and for delivering the fluids to the rig 12. Further, the well 20 may include a wellhead 24, which may be positioned proximal to the sea floor 16. The wellhead 24 may include wellhead equipment, such as rams, seals, etc. The riser 14 may connect to and extend upward from the wellhead 24. In some embodiments, casing 26 may be installed in well 20 extending downhole from the wellhead 24.

The system 10 may further include a riser fluid (e.g., riser gas) handling system 30. The riser fluid handling system 30 may be connected to the riser 14, as will be described in greater detail below. Further, a blowout preventer (BOP) 40 may be connected above the riser fluid handling system 30, as will also be described in greater detail below.

The riser 14 may include a lower portion 42 and an upper portion 44. The lower portion 42 may extend from the wellhead 24 to the riser fluid handling system 30. The upper portion 44 may extend from the BOP 40 up to the rig 12. Production tubing 50 may be received in the upper riser portion 44, the annular BOP 40, the riser fluid handling system 30, the lower riser portion 42, the casing 26, and into the subsea reservoir 22. An annular space 54 surrounds the production tubing 50 and is partially enclosed by the lower riser portion 42 and the upper riser portion 44.

Figure 2:
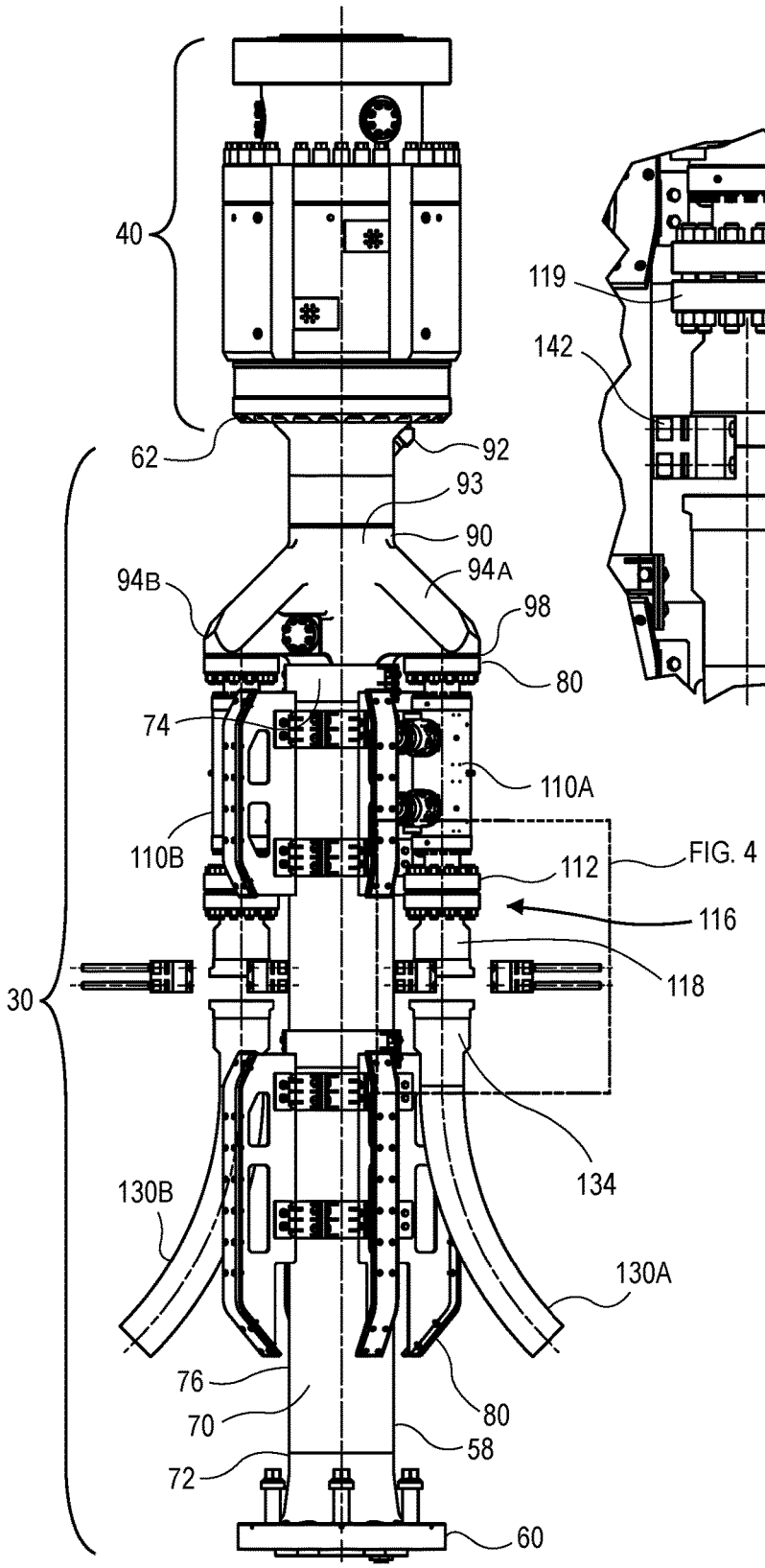
FIG. 2 illustrates a side, elevation view of a rig fluid handling system and a blowout preventer, according to an embodiment.
Figure 3:
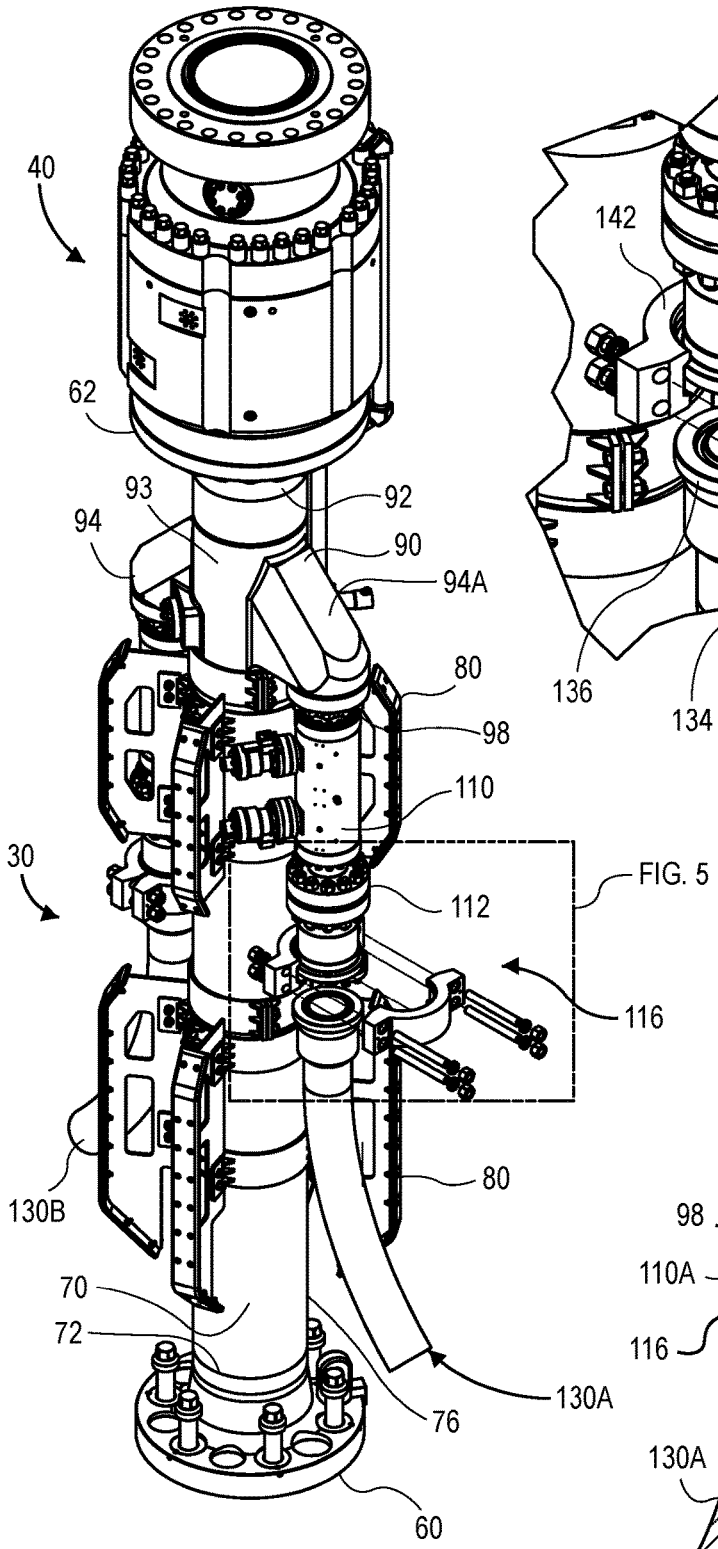
FIG. 3 illustrates a raised perspective view of the rig fluid handling system and the blowout preventer, according to an embodiment.

FIG. 2 illustrates a side, elevation view of the riser fluid handling system 30 and the BOP 40, according to an embodiment. FIG. 3 illustrates a raised perspective view of the riser fluid handling system 30 and the BOP 40, according to an embodiment. Referring to both FIGS. 2 and 3, the riser fluid handling system 30 includes a lower connector (e.g., a lower flange 60) and an upper connector (e.g., an upper flange 62). The lower flange 60 is configured for connection to the lower riser portion 42, e.g., via fasteners, and the upper flange 62 is configured to connection to the BOP 40 via fasteners. In at least some embodiments, the riser fluid handling system 30 may be defined between the flanges 60, 62.

For example, the riser fluid handling system 30 may generally include a tubular portion or "member" 70 that extends from the lower flange 60, and a flow spool 90 that extends from the upper flange 62 and connects to the tubular portion 70. The flow spool 90 and the tubular portion 70 may each be hollow, thereby defining a fluid flowpath in an axial direction therethrough, which, referring back to FIG. 1, may fluidly connect the upper riser portion 44 to the lower riser portion 42 via the BOP 40. As the term is used herein, "axial" and "axially" refer to a direction that is parallel to a central longitudinal axis of the riser fluid handling system 30. For example, the tubular portion 70 and the flow spool 90 may, in some embodiments, be coaxial, and thus, in such example, "axial" or "axially" refer to a direction parallel to their shared central axis. If the two are not coaxial, "axial" and "axially" refer to a direction generally between the upper and lower flanges 62, 60.

As shown in FIGS. 2 and 3, in an embodiment, the tubular portion 70 has a lower end 72 that connects to the lower flange 60, and an upper end 74 that connects to the flow spool 90. As such, the flow spool 90 is axially between the tubular portion 70 and the upper flange 62. The tubular portion 70 has an outside surface 76, and a plurality of bumpers 80 extend radially from the outside surface 76.

The flow spool 90 has upper end 92 that connects to the upper flange 62, and defines a base 93. The outer diameter of the base 93 may be approximately equal to the outer diameter of the tubular portion 70; however, the flow spool 90 also defines a plurality of fluid conduits (two are shown: 94A, 94B) that extend radially outward from the base 93, and thus outward from the tubular portion 70. The fluid conduits 94A, 94B may be integrally formed with the base 93, i.e., forming a single, monolithic piece, but in other embodiments, may be formed from two structural members that are connected together. In an embodiment, at least a portion of the fluid conduits 94A, 94B may extend at an angle to straight radial from the base 93, such that a fluid flowpath defined therein follows such a radial and axial orientation. In a specific embodiment, the fluid conduits 94A, 94B extend axially downward, toward the lower end 72 (e.g., the lower flange 60), as proceeding radially outward. In an embodiment, the fluid conduits 94A, 94B may not be curved or form part of a gooseneck.

An orifice 98 may be defined at the distal end of the fluid conduits 94A, 94B, opposite to the base 93. The orifice 98 may face axially downward, toward the lower flange 60. The fluid conduits 94A, 94B may be in communication with the interior of the base 93, and thus the interior of the riser 14. Fluid may thus be directed into or out of the riser 14 via the orifices 98 of the fluid conduits 94A, 94B.

As is best shown in FIG. 3, the fluid conduits 94A, 94B may be circumferentially offset from one another around the base 93 of the spool 90. In particular, as shown, two fluid conduits 94A, 94B may be provided, and may be approximately 180 degrees apart; however, this is merely an example.

The riser fluid handling system 30 further includes a plurality of valves (two are shown: 110A, 110B), each connected to the orifice 98 of one of the fluid conduits 94A, 94B of the spool 90. In particular, the individual valves 110A, 110B may be connected to a respective one of downwardly facing orifices 98 of the fluid conduits 94A, 94B. Further, the valves 110A, 110B may be located adjacent to the outside surface 76 of tubular portion 70 and extend parallel thereto, e.g., in an axial direction from the flow spool 90 toward the lower end 72 (e.g., the lower flange 60). The valves 110A, 110B may be positioned axially between the lower end 72 and the fluid conduits 94A, 94B.

The valves 110A, 110B may also be configured to be connected to drape hoses 130A, 130B. FIG. 3 illustrates an enlarged view of a connection assembly 116 for connecting the valve 110 to the drape hose 130A, according to an embodiment. It will be appreciated that a similar connection assembly may be provided for connecting the valve 110B to the drape hose 130B and/or any other valves to any other drape hoses.

Figure 4:
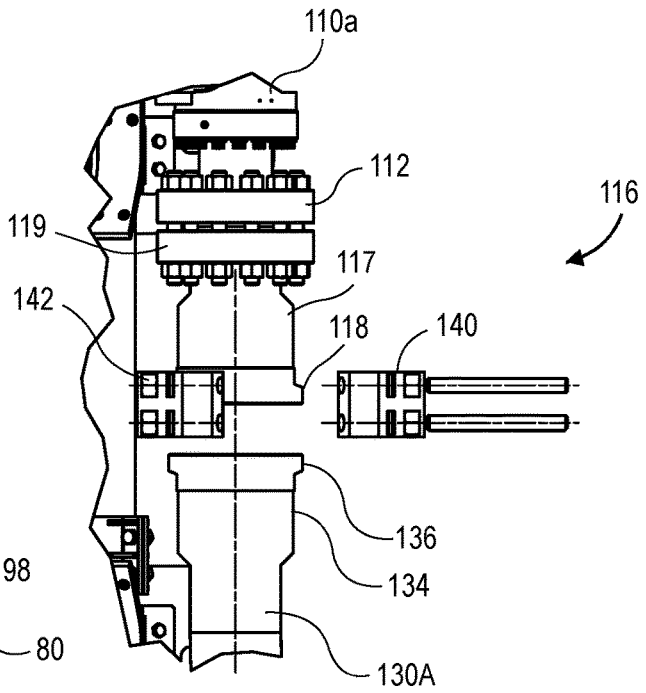
FIG. 4 illustrates an enlarged view of a portion of FIG. 2, showing a fluid conduit connected to a drape hose in greater detail, according to an embodiment.
Figure 5:
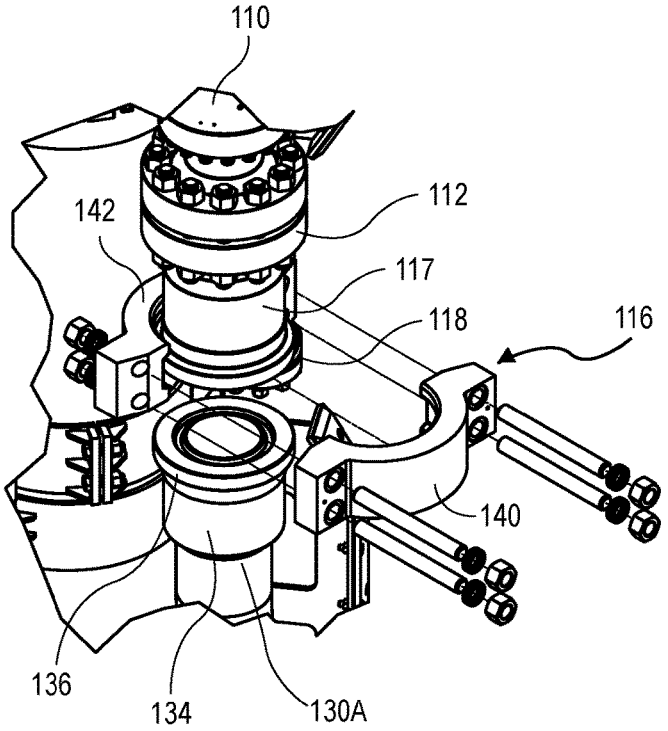
FIG. 5 illustrates an enlarged view of a portion of FIG. 3, showing the fluid conduit connected to the drape hose, according to an embodiment.

For example, the valves 110A may each have a lower flange 112. A connection assembly 116 may be connected to the lower flange 112. As shown in greater detail in FIGS. 4 and 5, the connection assembly 116 may include a body 117, a radial protrusion 118, and an upper flange 119. The upper flange 119 may be connected to the flange 112 of one of the valves (e.g., valve 110A). The body 117 may extend axially therefrom, e.g., substantially axially and without forming a gooseneck. The connection assembly 116 may also include a clamp, e.g., a first clamp section 140 and a second clamp section 142. The clamp sections 140, 142 may each be received partially around the radial protrusion 118 and a radial protrusion 136 located at a connection end 134 of the drape hose 130A.

The connection assembly 116 may provide for suspension of at least a portion of the drape hose 130A directly from the valve 110A and the spool 90. Further, the drape hose 130A may be permitted to "swivel" with respect to the other components, e.g., the valve 110A, the spool 90, and the tubular portion 70. In this context, "swivel" means the connection end 134 of the drape hose 130A can pivot or rotate about its central longitudinal axis. In the illustrated embodiment, the connection assembly 116 thus provides a clamp that does not restrain such swiveling motion. In other embodiments, a portion of the connection assembly 116 may be configured to reduce resistance to such swiveling, e.g., using a bearing.

The drape hose 130A may extend axially downward, toward the lower flange 60 from the valve 110A. Further, the drape hose 130A may curve from such an axial orientation to a generally radial orientation and eventually back to a generally axial orientation, back toward the rig 12, as shown in FIG. 1.

Figure 6:
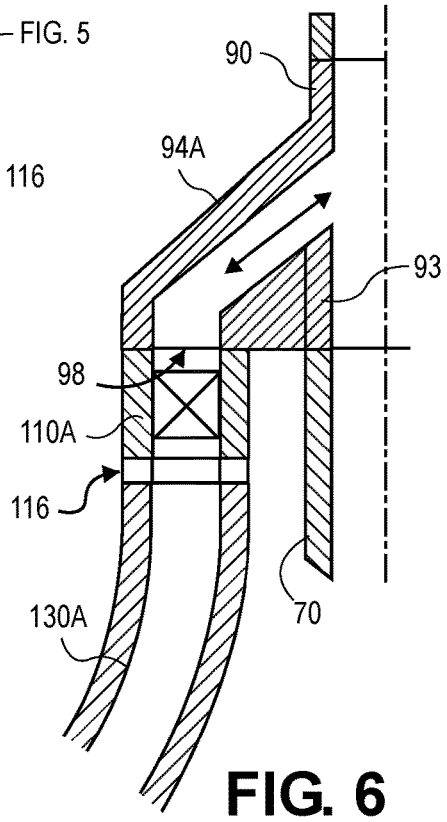
FIG. 6 illustrates a side, schematic view of the fluid conduit connected to the drape hose, according to an embodiment.

FIG. 6 illustrates a schematic, cross-sectional view of a portion of the riser fluid handling system 30, according to an embodiment. As mentioned above, the tubular portion 70 and the flow spool 90 (particularly the base 93 thereof) may be hollow, providing a fluid flowpath therethrough. Further, the fluid conduit 94A (other fluid conduits, e.g., fluid conduit 94B may be similar) may be integral with the base 93 and may extend radially outward and axially downward from the base 93, as shown. Further, the fluid conduit 94A is hollow, providing fluid communication therethrough. Additionally, the fluid conduit 94A terminates with the downwardly facing orifice 98, as noted above, which is connected to the valve 110A. In turn, the valve 110A is connected to the drape hose 130A via the connection assembly 116. The fluid conduit 94A thus imposes a single turn therein, which may be less than 90 degrees, e.g., where it turns to straight axial to provide the orifice 98. This may contrast with a gooseneck, which imposes two 90-degree turns to fluid flow.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A riser fluid handling system for managed pressure drilling, comprising:

a tubular portion having a lower end configured to be connected to a riser and an upper end;

a spool connected to the upper end of the tubular portion, the spool having a base and a fluid conduit extending radially outward from the base and defining an axially-facing orifice, wherein the fluid conduit is configured to provide fluid communication between the orifice and an interior of the spool, wherein the base defines a central passage along a central longitudinal axis, the central passage extends to a radial passage through the base, and the fluid conduit comprises a first angled portion extending directly from the radial passage at a first acute angle that is greater than 0 degrees and less than 90 degrees relative to the central longitudinal axis; and a valve connected to the fluid conduit and extending parallel to the central longitudinal axis, the valve being configured to connect to a drape hose such that the drape hose extends axially therefrom and is able to swivel with respect to the spool.

2. The riser fluid handling system of claim 1, wherein the fluid conduit extends at least partially axially downward, in a direction toward the lower end, and wherein the valve extends at least partially axially downward, in the direction toward the lower end, from the fluid conduit.

3. The riser fluid handling system of claim 1, further comprising the drape hose, wherein the drape hose is at least partially suspended from the fluid conduit and the valve and extends through a curve from an axial orientation to a radial orientation with respect to the tubular portion.

4. The riser fluid handling system of claim 1, further comprising a connector assembly that is configured to connect the drape hose to the valve and permits the drape hose to swivel with respect to the valve.

5. The riser fluid handling system of claim 4, wherein the connector assembly comprises:

one or more bearings configured to permit swiveling of the drape hose while connected to the connector assembly;

a cylindrical body having an upper end that is connected to the valve, and a lower end that defines a radial protrusion;

a first clamp section that is positionable partially around the radial protrusion of the lower end and partially around a connector end of the drape hose; and a second clamp section that is positionable partially around the radial protrusion of the lower end and partially around the connector end of the drape hose, wherein the first clamp section and the second clamp section are configured to be connected together to connect the drape hose to the valve via the cylindrical body.

6. The riser fluid handling system of claim 5, wherein the cylindrical body of the connector assembly extends substantially straight in an axial direction.

7. The riser fluid handling system of claim 1, wherein the valve is positioned axially between the lower end and the fluid conduit.

8. The riser fluid handling system of claim 1, wherein the valve is a first valve and the fluid conduit is a first conduit, the spool further comprising a second fluid conduit and a second valve connected to the second fluid conduit, extending axially downward therefrom, and connected to a second drape hose.

9. The riser fluid handling system of claim 1, wherein the fluid conduit and the base form a single monolithic piece, and the fluid conduit does not form part of a gooseneck.

10. The riser fluid handling system of claim 1, further comprising an upper flange connected to the spool and configured to connect to an annular blowout preventer (BOP).

11. The riser fluid handling system of claim 1, wherein the fluid conduit comprises a second angled portion extending directly from the first angled portion to the axially-facing orifice, the first angled portion is between the radial passage and the second angled portion, and the second angled portion turns and directs a fluid flow at a second acute angle relative to the first angled portion, and the second acute angle is greater than 0 degrees and less than 90 degrees.

12. A riser system, comprising:

a blowout preventer;

a riser;

a riser fluid handling system comprising:

an upper connector connected to the blowout preventer;

a lower connector connected to the riser;

a spool having an interior that is in fluid communication with the riser and the blowout preventer, the spool being connected to the upper connector, wherein the spool comprises a base and a plurality of fluid conduits extending radially and axially from the base and configured to fluidly communicate with the interior of the spool, wherein the base defines a central passage along a central longitudinal axis, the central passage extends to a plurality of radial passages through the base, and each fluid conduit of the plurality of fluid conduits comprises an angled portion extending directly from a respective radial passage of the plurality of radial passages at an acute angle that is greater than 0 degrees and less than 90 degrees relative to the central longitudinal axis; and a plurality of valves, each of the valves connected to a respective one of the fluid conduits; and a plurality of drape hoses, each of the drape hoses connected to a respective one of the valves, such that the drape hoses each extend axially, with respect to the spool, therefrom and each is able to swivel with respect to the spool.

13. The riser system of claim 12, wherein the drape hoses are each at least partially suspended from the valve to which the drape hose is connected.

14. The riser system of claim 12, further comprising a plurality of connector assemblies, each connected to a respective one of the valves and a respective one of the drape hoses.

15. The riser system of claim 14, wherein the plurality of connector assemblies each include:

a cylindrical body having an upper end that is connected to the one of the valves, and a lower end that defines a radial protrusion;

a first clamp section that is positionable partially around the radial protrusion of the lower end and partially around a connector end of the one of the drape hoses; and a second clamp section that is positionable partially around the radial protrusion of the lower end and partially around the connector end of the one of the drape hoses, wherein the first clamp section and the second clamp section are configured to be connected together to connect one of the drape hoses to one of the valves via the cylindrical body.

16. The riser system of claim 15, wherein the cylindrical body extends substantially straight in an axial direction, and wherein the connector assemblies are each free from goosenecks.

17. The riser system of claim 12, wherein the valves are circumferentially offset from one another around the base of the spool and are positioned axially between the lower end and the fluid conduits.

18. The riser system of claim 17, wherein the fluid conduits are positioned axially between the valves and the blowout preventer.

19. A riser system, comprising:

an upper flange configured to connect to a blowout preventer;

a lower flange configured to connect to a riser;

a spool connected to the upper flange, wherein the spool defines a central passage along a central longitudinal axis, and the central passage extends to a plurality of radial passages through the spool;

a tubular member connected to the lower flange and the spool, such that a fluid flowpath is defined between the upper and lower flanges via an interior of the spool and the tubular member;

a plurality of fluid conduits each comprising an angled portion extending directly from a respective radial passage of the plurality of radial passages at an acute angle that is greater than 0 degrees and less than 90 degrees relative to the central longitudinal axis, the fluid conduits being configured to fluidly communicate with the interior of the spool;

a plurality of valves, each of the valves connected to a respective one of the fluid conduits and extending therefrom toward the lower flange; and a plurality of connector assemblies, each connected to a respective one of the plurality of valves, wherein the plurality of connector assemblies extend straight in an axial direction and do not define a gooseneck, wherein the plurality of connector assemblies are configured to connect to a plurality of drape hoses such that the drape hoses each extend downward therefrom, toward the lower flange, and curve toward a radial orientation, with respect to the spool, wherein the connector assemblies are configured to permit the drape hoses to swivel with respect to the spool, and wherein the connector assemblies are configured to suspend at least a portion of the drape hoses from the valves and the fluid conduits.

20. The riser fluid handling system of claim 19, wherein the plurality of connector assemblies each comprises a quick connector comprising:

a cylindrical body having an upper end that is connected to the one of the valves, and a lower end that defines a radial protrusion;

a first clamp section that is positionable partially around the radial protrusion of the lower end and partially around a connector end of the one of the drape hoses; and a second clamp section that is positionable partially around the radial protrusion of the lower end and partially around the connector end of the one of the drape hoses, wherein the first clamp section and the second clamp section are configured to be connected together to connect the one of the drape hoses to the one of the valves via the cylindrical body.

* * * * *